US005170953A

United States Patent [19]

Stahlecker

[11] Patent Number: 5,170,953

[45] Date of Patent: Dec. 15, 1992

[54] SERVICING APPARATUS WHICH CAN BE MOVED ALONG A SPINNING MACHINE AND HAS DEVICES FOR SEEKING A YARN END FROM A SPOOL PACKAGE

[75] Inventor: Fritz Stahlecker, Bad Überkingen, Fed. Rep. of Germany

[73] Assignee: Hans Stahlecker, Fed. Rep. of Germany; a part interest

[21] Appl. No.: 693,028

[22] Filed: Apr. 30, 1991

Related U.S. Application Data

[63] Continuation of Ser. No. 392,465, Aug. 11, 1989, abandoned.

[30] Foreign Application Priority Data

Aug. 12, 1988 [DE] Fed. Rep. of Germany ..... 3827345

[51] Int. Cl.[5] ..... B65H 54/26

[52] U.S. Cl. ..... 242/35.5 A; 242/35.5 R; 242/35.6 R; 242/35.6 E; 57/263

[58] Field of Search ..... 242/35.5 A, 35.5 R, 242/35.6 R, 35.6 E, 18 R; 57/261, 263

[56] References Cited

U.S. PATENT DOCUMENTS

| | | | |
|---|---|---|---|
| 4,041,684 | 8/1977 | Kamp | 57/263 |
| 4,541,233 | 9/1985 | Raasch et al. | 57/263 |
| 4,541,235 | 9/1985 | Raasch | 57/263 |
| 4,644,742 | 2/1987 | Lovas et al. | 57/263 |
| 4,693,070 | 9/1987 | Raasch | 57/263 |
| 4,723,720 | 2/1988 | Matsui et al. | 242/35.6 E X |
| 4,891,933 | 1/1990 | Raasch | 57/263 |

FOREIGN PATENT DOCUMENTS

| | | | |
|---|---|---|---|
| 1123698 | 8/1968 | United Kingdom | 242/35.6 R |

*Primary Examiner*—Stanley N. Gilreath

*Attorney, Agent, or Firm*—Evenson, Wands, Edwards, Lenahan & McKeown

[57] ABSTRACT

A servicing apparatus and method are disclosed for locating a yarn end on a spool package at respective ones of the plurality of spinning units. A mobile servicing unit includes an auxiliary driving roller for driving the spool package and a yarn seeking nozzle for seeking a yarn end on the spool package. To obtain a precisely spaced location of the yarn seeking nozzle from the outer circumference of the spool package for different diameter spool packages, devices are provided for determining the package diameter and for controlling the position of the yarn seeking nozzle in the radial direction of the spool package as a function of the determined diameter.

21 Claims, 4 Drawing Sheets

20
19
15
16
18
36
17
28
21
S
22
A
5
29
26
4
8
25
3
1
24
23
2
9
6
11
27
10
12
7
14
13

15
20
19
36
16
31
17
28
35
34
33
32
30
21
30A
A
29
4
3
8
25
26
24
23
5
2
1
9
6
11
10
27
12
7
14
13

15
20
19
16
36
31
17
37
38
30
21
28
30A
A
29
4
3
8
25
26
24
23
5
2
1
9
6
27
10
11
12
7
14
13

20
19
15
16
36
17
28
21
26
A
24
3
39
4
40
25
5
23
45
1
27
41
2
42
6
12
44A
43
7
44
14
13

SERVICING APPARATUS WHICH CAN BE MOVED ALONG A SPINNING MACHINE AND HAS DEVICES FOR SEEKING A YARN END FROM A SPOOL PACKAGE

This is a continuation of application Ser. No. 07/392,465, filed Aug. 11, 1989, now abandoned.

BACKGROUND AND SUMMARY OF THE INVENTION

The invention relates to a servicing apparatus which can be moved along a spinning machine and has devices for seeking and winding a yarn end from a spool package of a spinning unit. These devices contain an auxiliary driving roller which can be applied to the circumference of the spool package and, at a distance from this auxiliary driving roller, a yarn seeking nozzle which can be moved into a seeking position in direct proximity of the circumference of the spool package by means of an adjusting drive. This invention also relates to a method of operating a servicing apparatus to precisely locate the yarn seeking nozzle.

An arrangement of this type is described in U.S. patent application Ser. No. 07/350,350 filed May 11, 1989, now U.S. Pat. No. 5,016,432. Since in this arrangement the yarn seeking nozzle is applied to the spool package at a distance from the auxiliary driving roller, the filling ratio of the spool package considerably influences the precision with which the yarn seeking nozzle is positioned with respect to the spool package. If, on the other hand, the yarn seeking nozzle is arranged in close proximity of the auxiliary driving roller, the filling ratio of the spool package is unimportant. However, in practice, it is not always possible to implement this type of an arrangement.

An object of the invention is to construct a servicing apparatus of the initially mentioned type in such a manner that, irrespective of the diameter of the spool package, a precise adjustment of the yarn seeking nozzle is achieved in its seeking position, at any time.

This object is achieved in that devices are provided for the adapting of the seeking position of the yarn seeking nozzle to the respective diameter of the spool package.

By means of this construction, it is achieved that the yarn seeking nozzle is always applied to the circumference of the spool package at a precise constant distance so that the functioning of the yarn seeking nozzle is constantly ensured.

In a further development of preferred embodiments of the invention, it is provided that the adjusting drive is provided with a control device to which devices are assigned for the sensing of the diameter of the spool package. A sort of measuring of the diameter of the spool package takes place in this case which may be either directly or indirectly.

In another construction of the invention, it is provided that the yarn seeking nozzle is equipped with a switch which switches its adjusting drive and determines the reaching of the circumference of the spool package. This may, for example, be a mechanical limit switch. However, it may also be provided that the adjusting drive of the yarn seeking nozzle is equipped with a switching element which determines its striking against the spool package which acts as a stop, in which case the control of the adjusting drive will then expediently cause the yarn seeking nozzle to lift itself off again by a certain distance from the circumference of the spool package.

In another embodiment of the invention, it is provided that the devices for the sensing of the diameter of the spool package are constructed as devices which sense the applied position of the auxiliary driving roller. This auxiliary driving roller is applied to the circumference of the spool package anyhow, adapting its position to the diameter of the spool package. The position which will then be taken up by the auxiliary driving roller may also be analyzed as a signal indicating the diameter of the spool package.

Other objects, advantages and novel features of the present invention will become apparent from the following detailed description of the invention when considered in conjunction with the accompanying drawings.

DETAILED DESCRIPTION OF THE DRAWINGS

In the following description of the embodiments according to FIGS. 1 to 4, the same reference numbers are used for the same or corresponding parts. These parts are therefore described in connection with FIG. 1.

Figure 1:
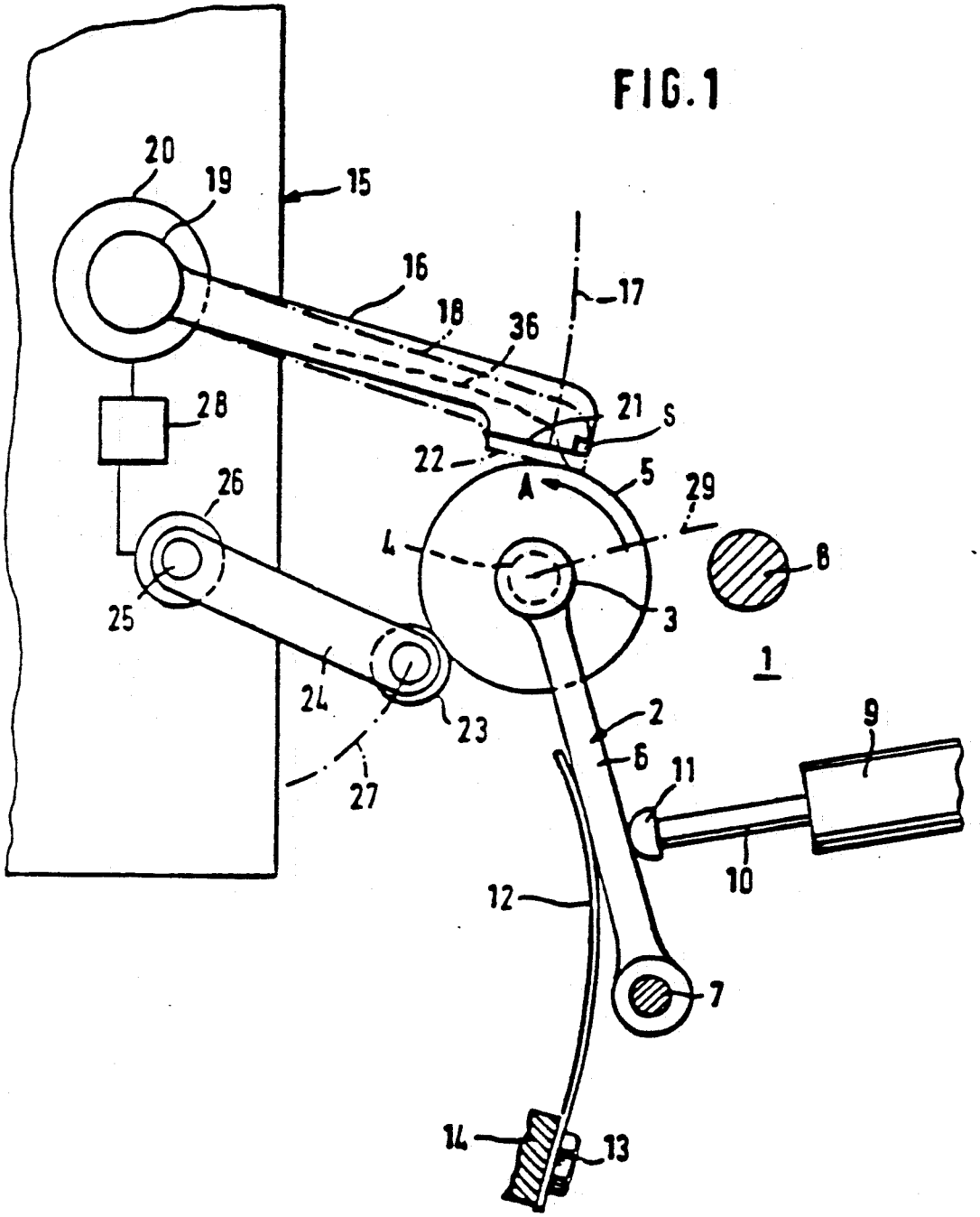
FIG. 1 is a schematic view of a part of a servicing apparatus and of a spinning unit, in which case only that part of the servicing apparatus is shown which represents the devices for the seeking and winding of a yarn end from a spool package construction according to a preferred embodiment of the invention.

FIG. 1 shows the wind-up mechanism of a spinning unit 1 of a spinning machine, by means of which a yarn can be wound on a spool package 5. The spool package 5 has a spool package tube 4 on which a yarn, particularly a double yarn, is wound. The yarn tube 4, on its face, is held by means of disks 3 which are mounted at two lateral arms 6 of a spool package frame 2. The arms 6 can be swivelled around a shaft 7 extending in the longitudinal direction of the machine. In the operating position, the spool package 5, with its circumference, rests against a wind-up roller 8 which is a driven cylinder running through in longitudinal direction of the machine. The pressure force with which the spool package 5 rests against the wind-up roller 8 is determined by a leaf spring 12 which presses the spool package frame 2 in the direction of the wind-up roller 8. The leaf spring 12 is held at one end at a stationary part 14 of the machine by means of a screw 13.

Each spinning unit contains devices for detecting a yarn breakage which are not shown. If such a yarn breakage is detected, the spool package 5 is separated from the wind-up roller 8. This takes place by means of a pneumatic press 9 which, in a manner not shown in detail, is controlled by the yarn detector. The piston 10 of the pneumatic press 9, the end of which is equipped with a thrust piece 11, is applied to the spool package frame 2 and swivels this spool package frame 2 around its swivel shaft 7, while the spool package 5 moves along the orbit 29.

For eliminating a yarn breakage, which is carried out by a fully automatically operating servicing apparatus 15, a yarn end 36 must be sought on the circumference of the cross-wound spool package 5 and must be wound off in wind-off direction (A). For this purpose, the servicing apparatus is equipped with an auxiliary driving roller 23 which is arranged on an arm 24 which can be swivelled around a shaft 25. The auxiliary driving roller 23 is equipped with a drive which is not shown, by means of which it can be driven in both rotating directions, so that it can drive the spool package 5 in wind-off direction (A) as well as in the opposite direction for the winding-up. The arm 24 can be swivelled around the shaft 25 by means of the operating motor 26, in which case, the auxiliary driving roller 23 moves along the orbit 27 until it rests against the circumference of the spool package 5 (with sufficient force).

A yarn seeking nozzle 16 of the servicing apparatus 15 is applied to the circumference of the spool package 5 at a relatively large distance with respect to the auxiliary driving roller 23, i.e., in the case of the embodiment shown, almost diametrically to it. The yarn seeking nozzle 16, with its mouth 21, must be located at a precisely defined distance to the outside diameter of the spool package 5 in the seeking position, irrespective of the respective diameter of the spool package 5. The yarn seeking nozzle 16 can be adjusted around a hollow shaft 19 along the orbit 17 by means of an adjusting drive 20. The adjusting drive 20 which, for example, contains a step motor, like the adjusting drive 26 of the auxiliary driving roller 23, is controlled by means of a control device 28.

In the embodiment according to FIG. 1, it is provided that the yarn seeking nozzle 16 is applied in such a manner that the mouth 21 takes up position 22 in which it rests against the circumference of the cross-wound spool package 5. The yarn seeking nozzle 16 will then be in the dash-dotted position 18. In this position, the auxiliary driving roller 23 will not yet be driven so that the spool package 5 is stopped. The reaching of position 18 is determined by means of a suitable switchs. This may, for example, be a limit switchs on the nozzle 16 which places itself on the circumference of the spool package 5. But it may also be a motion sensor which is arranged inside an adjusting drive 20 and determines when the yarn seeking nozzle 16 strikes against the circumference of the spool package 5 and thus comes to a stop. This motion sensor may be in the form of an electrical current consumption detector for the driving motor for pivoting the nozzle 6, which detector stops the driving motor when a predetermined current consumption level is reached which is indicative of the nozzle hitting the package 5. The control 28 provides that the adjusting drive 20 will then be driven by a given amount in lifting direction so that it takes up a seeking position irrespective of the respective diameter of the spool package 5, in which it maintains a precisely given distance with respect to the circumference of the spool package 5.

The spool package diameter can also be determined by the position of the auxiliary driving roller 23. For example, adjusting drive 26 can include an angle of rotation sensor for sensing the angle of inclination of arm 24, which in turn reflects the diameter of spool package 5.

Figure 2:
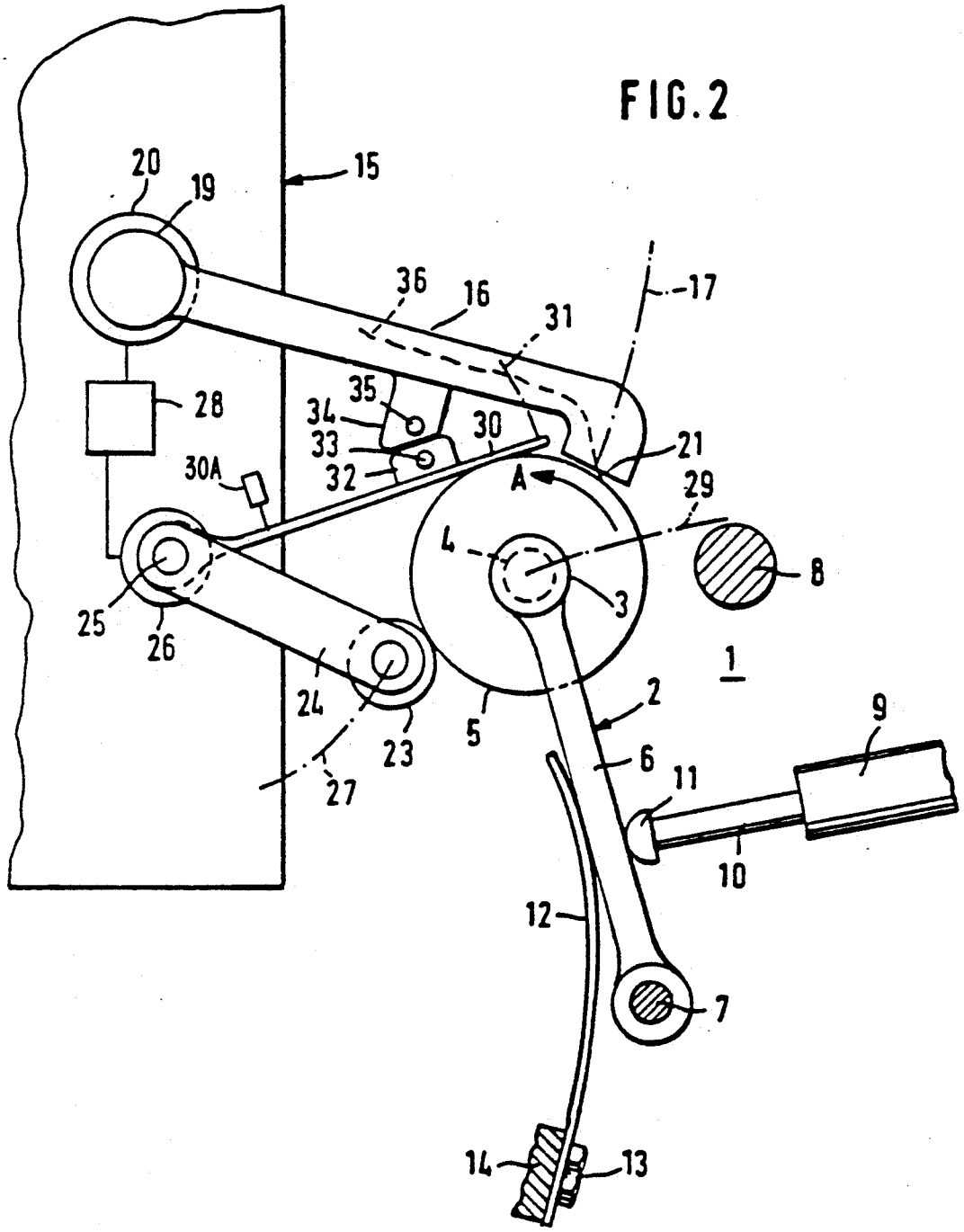
FIG. 2 is a schematic view of an embodiment similar to FIG. 1, in which a feeling device is provided for feeling the diameter of the spool package.

In the embodiment according to FIG. 2, the servicing apparatus 15 is equipped with a pivotable feeling device 30 which can be swivelled by pneumatic piston-cylinder unit 30A around the shaft 25 of the arm 24 of the auxiliary wind-up roller 23 and which places itself on the outer circumference of the spool package 5. The feeling device 30, which has a needle-type shape, takes up a position which depends on the diameter of the spool package 5. It is equipped with a holder 32 at which a sensor 33 is arranged, such as an optical sensor. At the yarn seeking nozzle 16, a corresponding holding device 34 is arranged which has a corresponding sensor 35, such as also an optical sensor. When the yarn seeking nozzle 16 takes up a position relative to the feeling device 30, which then, at the same time, will correspond to a certain position with respect to the circumference of the spool package 5, a corresponding signal will be emitted to the control 28, by means of which the seeking position of the yarn seeking nozzle 16 is fixed. For the continued operation, the feeling device 30 can then be removed again from the spool package 5 by operation of unit 30A.

Figure 3:
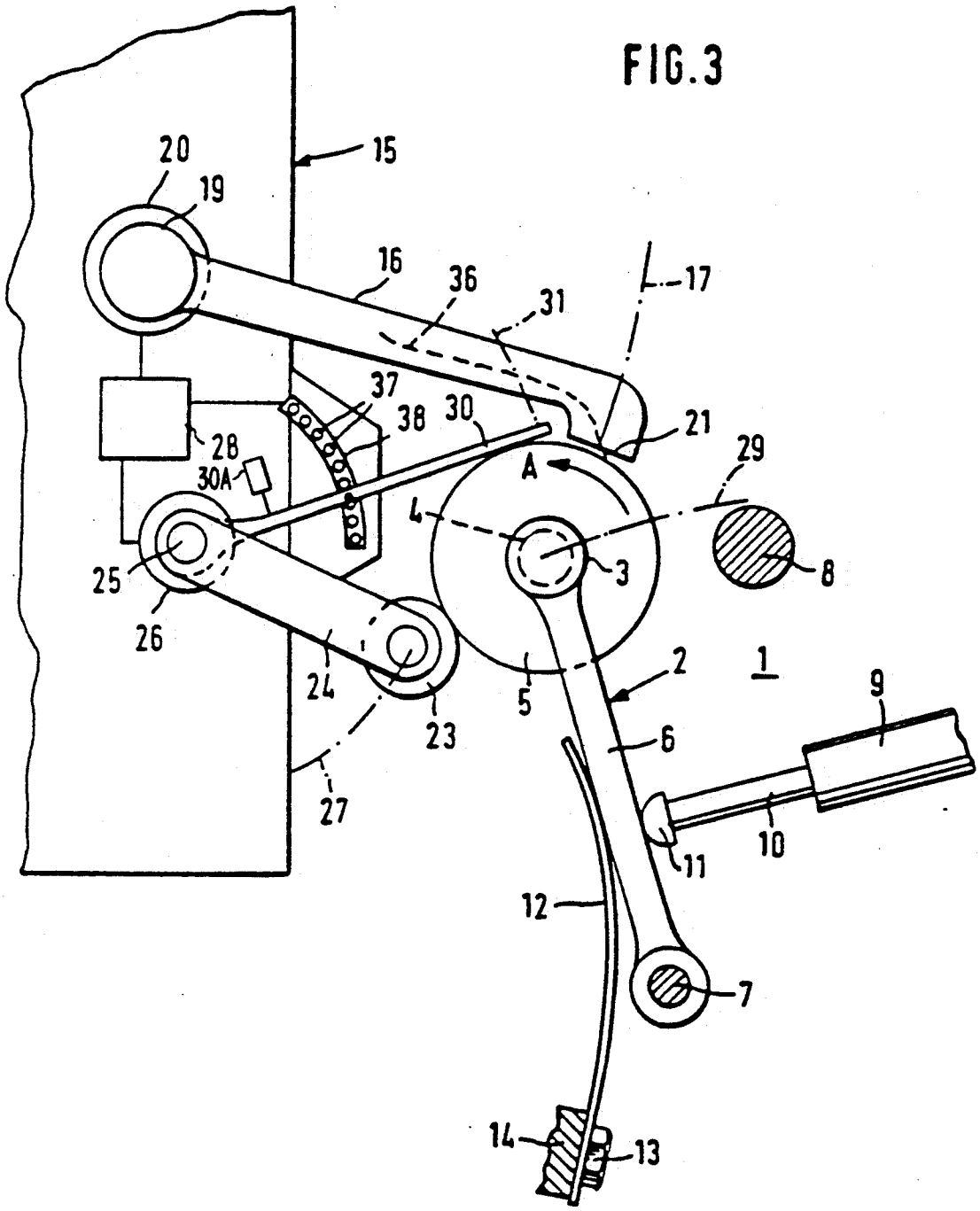
FIG. 3 is a schematic view of an embodiment similar to FIG. 2 having a modified feeling device.

In the embodiment according to FIG. 3, a feeling device 30 is also provided which is pivotable by pneumatic piston-cylinder unit 30A around shaft 25 and which is placed on the circumference of the spool package 5. The position of this feeling device 30 is monitored by sensors 37 which are stationarily arranged on a holding device 38 of the servicing apparatus 15, so that, in this manner, a signal is obtained which is dependent on the diameter of the spool package 5 and which is fed to the control device 28. The control device 28 will then, corresponding to this signal, determine the seeking position of the yarn seeking nozzle 16; i.e., the position in which the mouth 21, in the case of a determined diameter of the spool package 5, is located opposite this spool package 5 at a given distance. Also in this embodiment, after the diameter was determined, the feeling device 30 can be lifted off the spool package again by device 30A.

Figure 4:
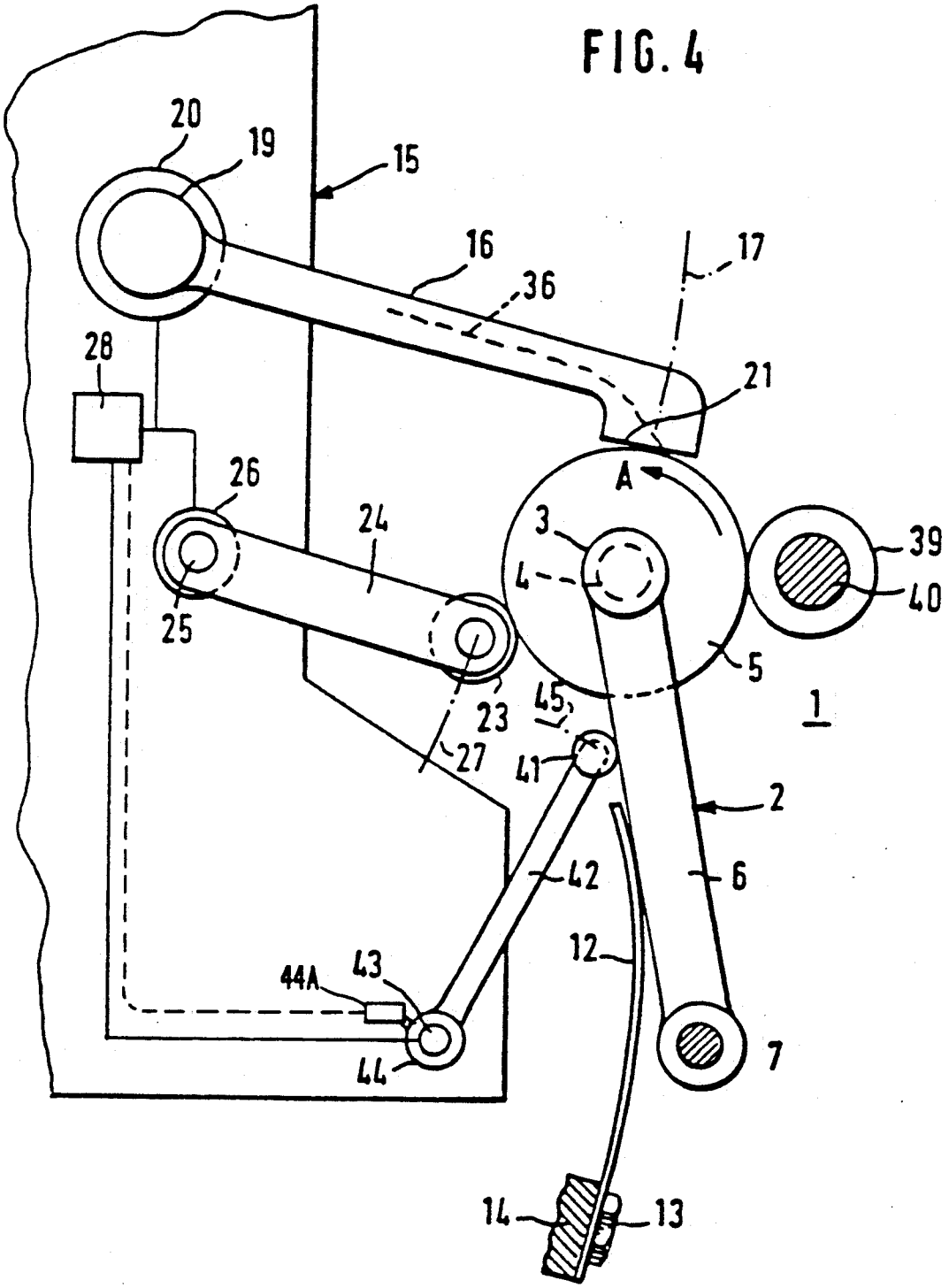
FIG. 4 is a schematic view which is similar to the preceding figures, showing a further embodiment in which the position of a spool package frame is sensed which, in the operating position, occurs as a result of the diameter of the spool package, in order to precisely position the yarn seeking nozzle with respect to the spool package.

In the embodiment according to FIG. 4, the diameter of the spool package 5 is determined indirectly; i.e., by means of the operating position of the spool package frame 2. For this purpose, an arm 42 equipped with a feeler 41 is assigned to one of the arms 6 of the spool package frame, this arm 42 being adjustable around a shaft 43 of the servicing apparatus 15 by means of an adjusting drive 44. The feeler 41, which can be swivelled along an orbit 45, reports its position to the control apparatus 28 so that this control apparatus 28 has an information concerning the diameter of the spool package 5. For this purpose, the angle of rotation detector 44A is provided for detecting the angle of rotation of arm 22 and supplying a signal to control apparatus 18 representative of this angle, which in turn reflects the diameter of the spool package 5. Corresponding to this information, the yarn seeking nozzle 16 will then be applied to the tube 5. This manner of determining the diameter of the spool package 5 is recommended particularly if each spinning unit 1 has a driving roller 3 for the respective spool packages 5 which can be disconnected from a drive shaft 40, or if individual drives are provided. After a yarn breakage, the spool package 5 then does not have to be lifted off the driving roller. If an individual drive is provided, an auxiliary driving roller 23 may not be required in this case under certain circumstances, particularly if the individual driving roller can be driven in both rotating directions.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. A servicing apparatus for a spinning machine of the type which provides spun yarn wound onto a spool package at each of a plurality of spinning units, comprising:

an auxiliary driving roller, an auxiliary driving roller moving device for selectively applying the auxiliary driving roller to the circumference of the spool package for driving the spool package, a yarn seeking nozzle for seeking a yarn end on the spool package, an adjusting drive device for selectively moving the yarn seeking nozzle to a yarn seeking position in direct proximity to the spool package at a location spaced from the auxiliary driving roller, a spool package diameter determining device, and a spool package diameter accommodating controller for controlling the adjusting drive device to position the yarn seeking nozzle at different positions in dependence on the respective determined diameter of the spool package, whereby precise spaced location of the yarn seeking nozzle from the outer circumference of the spool package is achieved for different diameter spool packages.

2. A servicing apparatus according to claim 1, wherein a mobile unit is provided which is movable to respective servicing positions adjacent respective spinning units, said auxiliary driving roller and yarn seeking nozzle being carried at the mobile unit.

3. A servicing apparatus according to claim 2, wherein the spool package diameter determining device includes a feeler which is engageable with the circumference of the spool package, the position of the feeler serving as a control signal for the adjusting drive device.

4. A servicing apparatus according to claim 2, wherein the spool package diameter determining device includes apparatus for detecting the position of a component of the spinning unit which changes its position as a function of the diameter of the spool package.

5. A servicing apparatus according to claim 2, wherein the spool package diameter determining device includes apparatus for detecting the diameter of the spool package by detecting the applied position of the auxiliary roller at the circumference of the spool package.

6. A servicing apparatus according to claim 2, wherein spool package holding apparatus is provided for holding the spool package at a predetermined location out of driving contact with a normal spinning driving roller when said yarn seeking nozzle is brought to its yarn seeking position.

7. A servicing apparatus according to claim 1, wherein the spool package diameter determining device includes a switch provided at the yarn seeking nozzle which is configured to determine the reaching of the circumference of the spool package, and wherein said spool package diameter accommodating controller is activated by the switch to move the nozzle a predetermined radial distance from the spool package circumference.

8. A servicing apparatus according to claim 1, wherein the spool package diameter determining device includes a feeler which is engageable with the circumference of the spool package, the position of the feeler serving as a control signal for the adjusting drive device.

9. A servicing apparatus according to claim 1, wherein the spool package diameter determining device includes apparatus for detecting the position of a component of the spinning unit which changes its position as a function of the diameter of the spool package.

10. A servicing apparatus according to claim 1, wherein the spool package diameter determining device includes apparatus for detecting the diameter of the spool package by detecting the applied position of the auxiliary roller at the circumference of the spool package.

11. A servicing apparatus according to claim 1, wherein the spool package diameter determining device includes apparatus for detecting the position of a component of the spinning unit which changes its position as a function of the diameter of the spool package.

12. A servicing apparatus according to claim 1, wherein the spool package diameter determining device includes apparatus for detecting the diameter of the spool package by detecting the applied position of the auxiliary roller at the circumference of the spool package.

13. A servicing apparatus according to claim 1, wherein the spool package diameter determining device includes a switch provided at the yarn seeking nozzle which is configured to determine the reaching of the circumference of the spool package, and wherein said spool package diameter accommodating controller is activated by the switch to move the nozzle a predetermined radial distance from the spool package circumference.

14. A servicing apparatus according to claim 1, wherein spool package holding apparatus is provided for holding the spool package at a predetermined location out of driving contact with a normal spinning driving roller when said yarn seeking nozzle is brought to its yarn seeking position.

15. A servicing arrangement for a spinning machine of the type which provides spun yarn wound onto a spool package at each of a plurality of spinning units, comprising:

an auxiliary driving roller, an auxiliary driving mechanism for selectively applying the auxiliary driving roller to the circumference of the spool package for driving the spool package, a yarn seeking nozzle for seeking a yarn end on the spool package, an adjusting drive device for selectively moving the yarn seeking nozzle to a yarn seeking position in direct proximity to the spool package at a location spaced from the auxiliary driving roller, a spool package diameter determining device, and spool package diameter accommodating apparatus for controlling the adjusting drive to position the yarn seeking nozzle at different positions in dependence on the respective diameter of the spool package, whereby precise spaced location of the yarn seeking nozzle from the outer circumference of the spool package can be readily achieved for different diameter spool packages.

16. A servicing apparatus according to claim 15, wherein a mobile unit is provided which is movable to respective servicing positions adjacent respective spinning units, said auxiliary driving roller and yarn seeking nozzle being carried at the mobile unit.

17. A servicing apparatus according to claim 16, wherein spool package holding apparatus is provided for holding the spool package at a predetermined location out of driving contact with a normal spinning driving roller when said yarn seeking nozzle is brought to its yarn seeking position.

18. A servicing apparatus according to claim 15, wherein spool package holding apparatus is provided for holding the spool package at a predetermined location out of driving contact with a normal spinning driving roller when said yarn seeking nozzle is brought to its yarn seeking position.

19. A method of servicing a spinning machine of the type which provides spun yarn wound onto a spool package at each of a plurality of spinning units, including:

selectively operating an auxiliary driving roller, selectively applying the auxiliary driving roller to the circumference of the spool package for driving the spool package, seeking a yarn end on the spool package by using a yarn seeking nozzle, and selectively moving the yarn seeking nozzle to a yarn seeking position in direct proximity to the spool package at a location spaced from the auxiliary driving roller, wherein said selectively moving the yarn seeking nozzle includes positioning the yarn seeking nozzle at different predetermined positions in dependence on the respective diameter of the spool package so as to locate the yarn seeking nozzle with respect to the outer circumference of the spool package for different diameter spool packages.

20. A method according to claim 19, comprising selectively moving a mobile unit to respective servicing positions adjacent respective spinning units, said auxiliary driving roller and yarn seeking nozzle being carried at the mobile unit.

21. A method according to claim 19, wherein said positioning of the yarn seeking nozzle includes first placing the nozzle at the circumference of the spool package, followed by moving the yarn seeking nozzle a predetermined radial distance away from the spool package circumference.

* * * * *

UNITED STATES PATENT AND TRADEMARK OFFICE

CERTIFICATE OF CORRECTION

PATENT NO. : 5,170,953

DATED : December 15, 1992

INVENTOR(S) : Fritz STAHLECKER

It is certified that error appears in the above-indentified patent and that said Letters Patent is hereby corrected as shown below:

On the title page, item [63], delete "Continuation" and insert --Continuation-in-Part-- therein.

Signed and Sealed this

Fourteenth Day of December, 1993

*Attest:*

Bruce Lehman

BRUCE LEHMAN

*Attesting Officer*

*Commissioner of Patents and Trademarks*